US005322637A

United States Patent [19]

O'Grady

[11] Patent Number: 5,322,637

[45] Date of Patent: Jun. 21, 1994

[54] COMPOSITION, BLEACHING ELEMENT, METHOD FOR MAKING A BLEACHING ELEMENT AND METHOD FOR INHIBITING THE YELLOWING OF INTENTIONALLY DISTRESSED CLOTHING MANUFACTURED FROM DYED CELLULOSE FABRIC

[76] Inventor: Richard O'Grady, 4104 Brittany Pl., Pensacola, Fla. 32504

[21] Appl. No.: 711,047

[22] Filed: Jun. 6, 1991

Related U.S. Application Data

[63] Continuation-in-part of Ser. No. 612,222, Nov. 9, 1990, abandoned.

[51] Int. Cl.[5] ..... C01B 11/00; C01B 15/00; D06L 3/00

[52] U.S. Cl. ..... 252/186.25; 252/186.33; 252/186.36; 252/186.1; 8/107; 8/108.1; 8/111

[58] Field of Search ..... 252/186.33, 186.36, 252/186.1, 187.24, 186.25; 8/107

[56] References Cited

U.S. PATENT DOCUMENTS

| | | | |
|---|---|---|---|
| Re. 31,779 | 12/1984 | Alliger | 252/187.23 |
| 1,533,917 | 8/1925 | Kalser | 8/101 |
| 3,650,673 | 3/1972 | Ehner et al. | 8/137 |
| 3,945,936 | 3/1976 | Lucas et al. | 252/95 |
| 4,078,099 | 3/1978 | Mazzola | 427/213 |
| 4,084,747 | 4/1978 | Alliger | 239/4 |
| 4,086,067 | 4/1978 | Busch et al. | 51/296 |
| 4,126,717 | 11/1978 | Mazzola | 427/220 |
| 4,130,392 | 12/1978 | Diehl et al. | 8/111 |
| 4,136,052 | 1/1979 | Mazzola | 427/213 |
| 4,218,220 | 8/1980 | Kappler et al. | 8/102 |
| 4,243,391 | 1/1981 | Puchta et al. | 8/111 |
| 4,327,151 | 4/1982 | Mazzola | 428/407 |
| 4,391,723 | 7/1983 | Bacon et al. | 252/90 |
| 4,526,699 | 7/1985 | Jones et al. | 252/99 |
| 4,534,952 | 8/1985 | Rapson et al. | 423/478 |
| 4,569,780 | 2/1986 | Feinholz et al. | 252/90 |
| 4,575,887 | 3/1986 | Viramontes | 8/158 |
| 4,581,287 | 4/1986 | Smith et al. | 428/290 |
| 4,601,845 | 7/1986 | Namnath | 252/99 |
| 4,655,780 | 4/1987 | Chun et al. | 8/108.1 |
| 4,740,213 | 4/1988 | Ricci | 8/108.1 |
| 4,795,476 | 1/1989 | Bean et al. | 8/107 |
| 4,816,033 | 3/1989 | Hoffer | 8/158 |
| 4,832,864 | 5/1989 | Olson | 252/86 |
| 4,850,156 | 7/1989 | Bellaire | 51/293 |
| 4,900,323 | 2/1990 | Dickson et al. | 8/111 |
| 4,919,842 | 4/1990 | Dickson et al. | 252/186.43 |
| 4,961,751 | 10/1990 | Eissele et al. | 8/111 |
| 5,152,804 | 10/1992 | Eissele et al. | 23/313 R |
| 5,165,910 | 11/1992 | Oikawa et al. | 423/477 |
| 5,238,463 | 8/1993 | Arini et al. | 8/111 |

FOREIGN PATENT DOCUMENTS

| | | |
|---|---|---|
| 3217188 | 11/1983 | Fed. Rep. of Germany . |
| 2517710 | 12/1981 | France . |
| 50-132269 | 10/1975 | Japan . |
| 2118463A | 11/1983 | United Kingdom . |

OTHER PUBLICATIONS

Carbowax publication.

*Primary Examiner*—Richard D. Lovering
*Assistant Examiner*—Joseph D. Anthony
*Attorney, Agent, or Firm*—Jones & Askew

[57] ABSTRACT

A composition, bleaching agent, bleaching element, method for making a bleaching element and a method for intentionally distressing fabric, typically blue indigo denim cloth. The disclosed composition includes a mixture of an oxidizer and an acid that eliminates or substantially reduces yellowing of the fabric after acid washing. The preferred oxidizer is preferably selected from the group consisting of potassium permanganate, sodium permanganate and sodium hypochlorite. The preferred acid is an acid such as phosphoric acid. A bleaching element made in accordance with the present invention includes an abrading device impregnated with the composition of the present invention. The method for intentionally distressing fabric such as denim includes the step of tumbling or otherwise subjecting the fabric to a bleaching element made in accordance with the invention. The disclosed invention further includes a finished garment treated by the disclosed method for intentionally distressing fabric.

13 Claims, No Drawings

COMPOSITION, BLEACHING ELEMENT, METHOD FOR MAKING A BLEACHING ELEMENT AND METHOD FOR INHIBITING THE YELLOWING OF INTENTIONALLY DISTRESSED CLOTHING MANUFACTURED FROM DYED CELLULOSE FABRIC

CROSS-REFERENCE

This application is a continuation-in-part of U.S. patent application Ser. No. 07/612,222 filed in the U.S. Patent & Trademark Office on Nov. 9, 1990 now abandoned.

TECHNICAL FIELD

The present invention relates to the manufacture of clothing from dyed cellulose fabrics. More particularly, the present invention relates to a composition, bleaching agent, bleaching element and method for inhibiting the yellowing known to occur when manufacturing intentionally distressed, dyed cellulose fabrics.

BACKGROUND OF THE INVENTION

Clothing made from cellulose fabrics such as cotton is well known. For example, a denim fabric has been used for many years to manufacture work clothes such as jeans. Such clothing was produced with a starch based sizing that eased the manufacturing and handling processes, but resulted in a stiff relatively uncomfortable garment. Also, the fabric had been dyed with a dark blue indigo that, when washed, bled from the fabric. Thus, after a substantial period of wear and washing, the denim fabric lightened in color and the garment became more pliable and comfortable. In addition, the fabric took on a used or distressed appearance, particularly on the seams, panels and raised areas where the stitching had been made.

In time, and particularly recently, denim clothing has become more popular. Denim fabrics are being utilized not only to make work clothes, but for jackets, coats, shirts and a seemingly endless variety of other garments. The used or distressed look has likewise become fashionable. As a result, manufacturers of denim clothing have developed methods by which to distress denim fabric. One method employed to distress a denim fabric is known as "acid washing." This method typically consists of abrading the denim fabric through the use of pumice stones or some other abrading device such as silica sand to produce a softer, more pliable fabric with random, localized areas of lighter color.

Described more particularly, acid washing of a denim garment has been accomplished by the following steps. A quantity of garments are first washed in a solution to remove the starch-based sizing. The garments are then dry tumbled in a quantity of pumice rock or silica sand that has been impregnated with an oxidizer solution, usually potassium permanganate. After tumbling, the garments are washed in a neutralizing solution to remove any excess oxidizer. The garments are then dried in a conventional manner.

Other methods of distressing denim or other fabrics are known. For example, U.S. Pat. No. 4,740,213, issued on Apr. 26, 1988 to Francesco Ricci, discloses a method of producing a random faded effect on cloth or made-up garments, and the endproduct obtained by implementation of such a method. The method described in this patent comprises the steps of bleaching the cloth in a dry state, utilizing granules of pumice or similar materials impregnated with a fluid having powerful bleaching properties, tumbling the granules and cloth together in a rotating drum such that close contact is brought about between the two, recovering the granules following rotation of the drum for a set duration, and neutralizing any residual bleaching agent held in the cloth by washing and drying.

Another method of distressing fabrics is disclosed in U.S. Pat. No. 4,850,156, issued on Jul. 25, 1989 to David L. Bellaire. This patent discloses a method of preparing porous abrasive rock for use in distressing fabric including the steps of impregnating rocks placed in a vacuum vessel with a bleaching solution under reduced pressure, maintaining the reduced pressure for a first interval while injecting the solution beneath the rocks, and then increasing the vessel pressure above ambient for a second interval prior to removal and use of the rocks to abrade fabric.

These method have provided a distressed appearance to the denim fabric suitable for the many types of denim garments. However, it has been observed that the acid-washed denim fabric is susceptible to yellowing when exposed to ultraviolet light, such as sunlight. Such latent yellowing of the fabric is undesirable. Further, the intensity of the yellowing increases with the duration of the fabric's exposure to ultraviolet light. In some instances, the yellowing can be so severe that the finished garment is rendered unsaleable. It is not unusual for otherwise acceptable denim garments to yellow sufficiently to render the garments unsaleable. Thus, manufacturers of acid washed or distressed denim clothing seek to inhibit, if not eliminate, yellowing of the denim fabric.

Yellowing of the denim fabric is believed to result from the presence of anthranilic acid on or in the garment. The anthranilic acid is believed to be produced during the acid washing process. As noted above, denim fabric is conventionally treated with the well-known dye indigo. While naturally available, indigo dye can be and is synthesized for industrial use. Synthesized indigo dye is usually a blue powdery material with a copper luster. The principal coloring matter of indigo dye has a chemical formula of $C_{16}H_{10}O_2N_2$. During the acid washing process, the indigo dye oxidizes to produce isatin, a crystalline compound or indole that has oxygen molecules at carbon positions "2" and "3". Isatin is commonly orange to red in color, water soluble and has a chemical formula of $C_6H_5NO_1$.

As also noted above, at least one method of preparing pumice stones for use in the acid washing process is to soak or otherwise impregnate the stones with a bleaching agent such as potassium permanganate, $KM^nO_4$. An excess amount of potassium permanganate is usually present in the acid wash process. It is believed that this excess of potassium permanganate facilitates further oxidation of the isatin, resulting in the formation of anthranilic acid. Anthranilic acid is a white to pale powder and water soluble. It is known that, in time, anthranilic acid discolors to a yellow color. The chemical reaction whereby the anthranilic acid becomes discolored is not known to the inventor. However, the inventor is aware of the fact that such discoloring occurs. It is believed by the inventor that the presence of anthranilic acid on or within the distressed denim material is a, if not the, primary cause of the latent yellowing which occurs when acid-washed denim garments are exposed to ultraviolet light.

There is a need in the art, therefore, for a composition and method by which to inhibit the yellowing of denim fabric. This need has been recognized previously. Various chemicals have been used to attempt to combat this problem including ultraviolet and ozone inhibitors. For example, different methods and chemicals have been used to try to neutralize the bleaching agent in an effort to inhibit yellowing. Some of these attempts have included treating the acid-washed denim fabric with bisulfates. These methods, however, are expensive and have met with limited success. The need for a cost effective method and composition for inhibiting the yellowing of distressed denim fabric thus remains.

SUMMARY OF THE INVENTION

The present invention fulfills the above-described need in the prior art by providing a composition, a bleaching element, a method of making a bleaching element for distressing fabric and a method for distressing fabric whereby the tendency of acid-washed fabric to yellow is eliminated or substantially reduced. In specific, the present invention solves the problem of latent yellowing of finished, distressed denim garments experienced by manufacturers of such clothing.

Briefly described, the composition of the present invention comprises an acid and an oxidizer in solution that acts to inhibit yellowing of the denim fabric. In one preferred embodiment, the composition of the present invention comprises a solution of about 1 to 25% by weight of potassium permanganate as an oxidizer and about 0.5 to 50% by weight of phosphoric acid as an acid.

The bleaching element of the present invention includes the foregoing described composition. Described somewhat more particularly, the preferred bleaching element of the present invention is an abrading device such as pumice stone or silica sand impregnated with the foregoing described composition.

The method of the present invention for making a bleaching element for distressing fabric includes the step of impregnating an abrading device such as pumice stone or silica sand with the foregoing composition. Described somewhat more particularly, a preferred method of the present invention includes the step of impregnating an abrading device such as pumice stone with a composition in solution comprising an acid and an oxidizer. A preferred oxidizer is potassium permanganate. A preferred acid is phosphoric acid.

The method of the present invention for distressing fabric includes the step of tumbling fabric to be distressed in a tumbler with a plurality of bleaching elements made in accordance with the present invention. The bleaching elements abrade and bleach the fabric during the tumbling process, thereby distressing the fabric and producing the "acid-washed" appearance. It is believed that the composition of the present invention also acts to retard substantially or to stop entirely the oxidation process that results in the formation of anthranilic acid during a conventional acid-washing process. In this manner, it is believed that the present invention eliminates or greatly reduces the latent yellowing of the finished garment upon exposure to ultraviolet light.

Thus, it is an object of the present invention to provide an improved method for distressing fabric.

It is another object of the present invention to provide an improved bleaching element for use in distressing fabric.

It is a further object of the present invention to provide an improved method for making a bleaching element for use in distressing fabric.

It is a further object of the present invention to provide a composition for use in distressing fabric that eliminates or greatly reduces the yellowing of acid-washed fabrics.

It is a further object of the present invention to provide a method for distressing fabric that eliminates or greatly reduces the yellowing of acid-washed fabrics.

It is a further object of the present invention to provide a bleaching element for use in distressing fabric that eliminates or greatly reduces the yellowing of acid-washed fabrics.

It is a further object of the present invention to provide a method, bleaching element and composition to distress fabrics that increases the quantity of saleable end product by eliminating or greatly reducing the yellowing of acid-washed fabrics.

It is still a further object of the present invention to provide a method for distressing fabric that eliminates or greatly reduces yellowing of the fabric in an economical and efficient fashion.

These and other objects, features and advantages of the present invention will become apparent by a reading of the following detailed description in conjunction with the appended claims.

DETAILED DESCRIPTION OF THE PREFERRED EMBODIMENTS

The present invention includes a composition to be used in distressing fabric, particularly denim cloth, a bleaching element which includes this composition, a method of making such a bleaching element, a method of distressing fabric with this bleaching element, and a garment distressed with this bleaching element. The composition and bleaching element of the present invention are suited for use in a tumbling machine wherein fabric, typically denim cloth, is abraded and bleached to give the fabric a distressed or used appearance. In a preferred embodiment, the composition and bleaching element of the present invention are suited for acid-washing denim garments.

A composition made in accordance with the present invention includes a bleaching agent. A bleaching agent is a material that lightens or whitens a substrate through chemical action. Chlorine related compounds are well known bleaching agents. At least two classes of chlorine related compounds can be used as bleaching agents; including chlorine, hypochlorites and chlorite. Manganese compounds may also be used as a bleaching agent; for example, potassium permanganate and sodium permanganate. Permanganates are a purple salt of permanganic acid and typically used as oxidizing agents and disinfectant. Potassium permanganate has been found to be a preferred bleaching agent for use in the composition of the present invention. Potassium permanganate is a highly oxidative agent and is water soluble.

A composition made in accordance with the present invention also includes an acid. As defined herein, the acid is any compound that will lower the pH of an aqueous solution. The acid compound can be organic or inorganic. Suitable acids that can be used in the present invention include, but are not limited to, inorganic acids such as hydrochloric acid, sulfuric acid and phosphoric acid. A tribasic acid, more particularly phosphoric acid, has been found to be well suited for the preferred composition. Phosphoric acid is conventionally provided in liquid or solid form and has a chemical formula $H_3PO_4$. For example, pure phosphoric acid is a white crystalline, water soluble solid. The inventor know of no reason why other inorganic acids could not be utilized within the scope of the present invention. It is thus to be understood that a preferred composition of the present invention is provided as an aqueous solution.

The bleaching element of the present invention can be made by impregnating an abrading device with the composition of the invention. Those of ordinary skill in the art will appreciate that the abrading device is thus susceptible to impregnation by the composition. Suitable abrading devices include pumice stone and silica sand. Other suitable abrading devices include diatamateous earth and di-calcium phosphate or various binders of mineral aggregates. Such abrading devices are known in the art but, as detailed below, have not been treated with the composition of the present invention.

The bleaching element of the present invention is preferably made by impregnating the abrading device with the composition of the present invention. Such impregnation may be accomplished in any suitable manner, including by soaking the abrading device in a solution of a predetermined amount of an acid such as phosphoric acid, an oxidizer such as potassium permanganate, and water. For example, a predetermined quantity of pumice stone may be introduced into the solution and permitted to soak in the solution for a time sufficient to impregnate the stone. At the expiration of such a time, the stone is withdrawn from the solution and dried. The stones are then ready for use in the distressing process of the present invention.

To treat fabric or a garment with the bleaching element of the present invention, the bleaching elements may be made in accordance with the above-described method. A method of distressing fabric in accordance with the present invention includes abrading fabric with such bleaching elements. A quantity of these bleaching elements are loaded into a tumbling machine containing the fabric or garments to be treated. The fabric or garments are tumbled in the tumbler with the bleaching elements to give the fabric or garments the desired acid-washed appearance and feel. Once the tumbling action is concluded, the fabric or garments are removed from the tumbler and "derocked," meaning that any particulate matter contained on or in the material is removed. The garments are then rinsed in a neutralizing solution. The rinse may, but need not, include a neutralizing agent such as a bisulfate compound. The fabric or garments are then dried and may be further processed for retail sales.

Those skilled in the art will appreciate that the fabric or garment has been abraded or "acid-washed" in order to obtain a fashionable and comfortable garment. Moreover, it has been discovered by the inventor that fabric and garments that have been treated in this manner do not yellow when exposed to sunlight. The following example is provided to yet further describe the present invention and to disclose the best mode contemplated by the inventor of carrying out the invention.

EXAMPLE I

Two sets of bleaching elements were made, one control group and one test group made in accordance with the present invention.

Control Group

The control group was made as follows. A one hundred (100) gallon tank was filled with approximately fifty (50) gallons of water. The temperature of the water was approximately 120° Fahrenheit. Eighteen pounds (18 lbs.) of crystalline potassium permanganate was added to the water in the tank. The solution was well mixed, by motor-driven propeller, for a period of ten (10) minutes. Approximately fifty pounds (50 lbs.) of pumice stone was then placed into the solution. The pumice stone was left in the solution for a period of approximately thirty (30) minutes. The pumice stone was then removed from the solution and allowed to air dry under ambient conditions for approximately twenty (20) minutes.

Test Group

The test group was made in accordance with the present invention as follows. A one hundred (100) gallon tank was filled with approximately fifty (50) gallons of water. The temperature of the water was approximately 120° Fahrenheit. Eighteen pounds (18 lbs.) of crystalline potassium permanganate was added to the water in the tank. In addition, one (1) gallon of 75% by weight phosphoric acid was added to the water. This solution was well mixed, by a motor-driven propeller, for a period of ten (10) minutes. Approximately fifty pounds (50 lbs.) of pumice stone was then placed in the solution. The pumice stone was left in the solution for a period of approximately thirty (30) minutes. The pumice stone was then removed from the solution and allowed to air dry under ambient conditions for approximately twenty (20) minutes.

Twenty pairs of new, blue indigo dyed jeans made of a denim fabric were placed into a two hundred and fifty pound (250 lb.) capacity Milnor "open pocket" washing machine. The washing machine was filled with approximately eighty (80) gallons of water. The temperature of the water was approximately 145° Fahrenheit. A quantity of approximately twenty-four ounces (24 oz.) of alpha amalyze enzyme was added to the water in the washing machine. The jeans were washed (or desized) in this solution for a period of approximately fifteen (15) minutes. At the conclusion of this time period, the solution was drained from the washing machine.

The washing machine was then refilled with eighty (80) gallons of clean water. The temperature of the water was approximately 110° Fahrenheit. The jeans were rinsed in this water through activation of the washing machine for a period of approximately five (5) minutes. At the conclusion of this time period, the water was drained from the washing machine. The jeans were then spun in the washing machine to remove excess water. The jeans were then removed from the washing machine and drained in a conventional dryer. This completed the "pre-washing" process for all twenty (20) pairs of jeans.

Ten pairs of the pre-washed jeans were placed in a Troy "belly washer" tumbling machine having a perforated drum. The control group bleaching elements, comprising approximately fifty pounds (50 lbs.) of pumice stone soaked in solution including potassium permanganate, were placed in the tumbling machine. The jeans were tumbled in the tumbling machine for a period of approximately twenty (20) minutes. At the conclusion of this time period, the jeans were removed from the tumbling machine. The jeans were then derocked. The jeans were then placed in a two hundred and fifty pound (250 lb.) washing machine. The washing machine was filled with approximately eighty (80) gallons of water. The temperature of the water was approximately 140° Fahrenheit. A quantity of a neutralizing agent, namely, five pounds (5 lbs.) of hydroxalamine sulphate was added to the water. (It is to be understood that a bisulfate or an acetic and peroxide mixture could also be used as a neutralizing agent.) The jeans were washed in this solution for a period of approximately eighteen (18) minutes. At the conclusion of this time period, the solution was drained from the washing machine.

The washing machine was then refilled with eighty (80) gallons of clean water. The temperature of the water was approximately 120° Fahrenheit. The jeans were rinsed in this water through activation of the washing machine for a period of approximately five (5) minutes. The jeans were then spun in the washing machine to remove excess water. The jeans were then removed from the washing machine and dried in a conventional dryer. This completed the "acid washing" process for these ten (10) pairs of jeans.

The remaining ten (10) pairs of the pre-washed jeans were likewise placed in a Troy "belly washer" tumbling machine having a perforated drum. This tumbling machine was not the same as that used previously. This time, however, the test group bleaching elements, made in accordance with the present invention and comprising fifty pounds (50 lbs.) of pumice stone soaked in solution including potassium permanganate and phosphoric acid, were placed in the tumbling machine. The jeans were tumbled in the tumbling machine for a period of approximately twenty (20) minutes. At the conclusion of this time period, the jeans were removed from the tumbling machine. The jeans were then derocked. The jeans were then placed in a two hundred and fifty pound (250 lb.) Milnor washing machine. The washing machine was filled with approximately eighty (80) gallons of water. The temperature of the water was approximately 140° Fahrenheit. A quantity of a neutralizing agent, namely, five pounds (5 lbs.) of hydroxalamine sulphate was added to the water. The jeans were washed in this solution for a period of approximately eighteen (18) minutes. At the conclusion of this time period, the solution was drained from the washing machine.

The washing machine was then refilled with eighty (80) gallons of clean water. The temperature of the water was approximately 120° Fahrenheit. The jeans were rinsed in this water through activation of the washing machine for a period of approximately five (5) minutes. The jeans were then spun in the washing machine to remove excess water. The jeans were then removed from the washing machine and dried in a conventional dryer. This completed the "acid washing" process for these jeans.

Five (5) pairs of jeans treated with the control group bleaching elements and five (5) pairs of jeans treated with the test group bleaching elements were placed in direct sunlight for a period of approximately ten (10) hours. At the conclusion of this time period, a visual examination of all ten (10) pairs of jeans was conducted. It was found that the five (5) pairs of jeans tumbled in with the control group bleaching elements had yellowed greatly, but the five (5) pairs of jeans tumbled with the test group bleaching elements had retained this original blue color and had not yellowed.

Similarly, the remaining five (5) pairs of jeans treated with the control group bleaching elements and the remaining five (5) pairs of jeans treated with the test group bleaching elements were placed in ultraviolet light cabinets for a period of approximately four (4) hours. It is to be understood that these remaining ten (10) pairs of jeans were subjected to direct ultraviolet light. At the conclusion of this time period, a visual examination of all ten (10) pairs of jeans was conducted. It was found that, as with the pairs of jeans exposed to direct sunlight, the five (5) pairs of jeans tumbled with the control group bleaching elements had yellowed greatly, but the five (5) pairs of jeans tumbled with the test group bleaching elements had retained their original blue color and had not yellowed.

The foregoing description and examples of the preferred embodiments of the present invention are given by way of illustration. In light thereof, those of ordinary skill in the art will appreciate that various modifications made are made without departing from the spirit and scope of the present invention.

What is claimed is:

1. A bleaching element for distressing fabric, comprising:

an abrading device selected from the group consisting of pumice stone, silica sand, diatamatious earth, and dicalcium phosphate, the abrading device being impregnated with: (I) a bleaching agent having a molecular structure comprising an element selected from the group consisting of chlorine and manganese, and (II) an acid; the bleaching element being made according to a process comprising the steps of:

soaking the abrading device in an aqueous solution for a time sufficient for the aqueous solution to impregnate the abrading device, said aqueous solution consisting essentially of the bleaching agent, the acid, and water, the bleaching agent being present in an amount from about 1 to 25% by weight of the aqueous solution and the acid being present in an amount from about 0.5 to 50% by weight of the aqueous solution:

thereafter, withdrawing the abrading device from the aqueous solution; and drying the abrading device, whereby the bleaching agent is present in the bleaching element in an amount sufficient to bleach the fabric to be distressed when the bleaching element is tumbled with the fabric in a tumbler, and the acid is present in the bleaching element in an amount sufficient to eliminate latent yellowing of the fabric due to exposure of the fabric to ultraviolet light.

2. The bleaching element of claim 1 wherein said bleaching agent is selected from the group consisting of potassium permanganate, sodium permanganate and sodium hypochlorite.

3. The bleaching element of claim 1 wherein said bleaching agent comprises potassium permanganate and said acid comprises phosphoric acid, said bleaching element having a substantially exposed outer surface which allows for direct contact between the abrading device and the fabric to be distressed so that the outer surface of the bleaching element can abrade and bleach the fabric.

4. The bleaching element of claim 1 wherein the acid comprises phosphoric acid.

5. The bleaching element of claim 1 wherein the bleaching agent is selected from the group consisting of potassium permanganate, sodium permanganate and sodium hypochlorite and the acid comprises phosphoric acid.

6. A method for making a bleaching element for distressing fabric and inhibiting any latent yellowing of the fabric comprising the steps of:

soaking an abrading device in an aqueous solution for a time sufficient for the aqueous solution to impregnate the abrading device, said aqueous solution consisting essentially of: (I) a bleaching agent having a molecular structure comprising an element selected from the group consisting of chlorine and manganese, (II) an acid, and (III) water; the bleaching agent being present in an amount from about 1 to 25% by weight of the aqueous solution and the acid being present in an amount from about 0.5 to 50% by weight of the aqueous solution:

thereafter, withdrawing the abrading device from the aqueous solution; and drying the abrading device, whereby the bleaching agent is present in the bleaching element in an amount sufficient to bleach the fabric to be distressed when the bleaching element is tumbled with the fabric in a tumbler, and the acid is present in the bleaching element in an amount sufficient to eliminate latent yellowing of the fabric due to exposure of the fabric to ultraviolet light.

7. The method of claim 6 wherein said bleaching agent is selected from the group consisting of potassium permanganate, sodium permanganate and sodium hypochlorite.

8. The method of claim 6 wherein the acid comprises phosphoric acid.

9. The method of claim 6 wherein the bleaching agent is selected from the group consisting of potassium permanganate, sodium permanganate and sodium hypochlorite and the acid comprises phosphoric acid.

10. A method for distressing fabric and inhibiting any latent tendency of the fabric to yellow comprising the step of:

tumbling a fabric to be distressed in a tumbler with a plurality of bleaching elements for a time sufficient to distress the fabric and impart an acid-washed appearance to the fabric, each said bleaching element comprising an abrading device selected from the group consisting of pumice stone, silica sand, diatamatious earth, and dicalcium phosphate, the abrading device being impregnated with: (II) a bleaching agent having a molecular structure comprising an element selected from the group consisting of chlorine and manganese, and (II) an acid; the bleaching elements being made according to a process comprising the steps of:

soaking the abrading devices in an aqueous solution for a time sufficient for the aqueous solution to impregnate the abrading devices, said aqueous solution consisting essentially of the bleaching agent, the acid, and water, the bleaching agent being present in an amount from about 1 to 25% by weight of the aqueous solution and the acid being present in an amount from about 0.5 to 50% by weight of the aqueous solution;

thereafter, withdrawing the abrading devices from the aqueous solution; and drying the abrading devices, whereby the bleaching agent is present in the bleaching elements in an amount sufficient to bleach the fabric to be distressed when the bleaching elements are tumbled with the fabric in a tumbler, and the acid is present in the bleaching elements in an amount sufficient to eliminate latent yellowing of the fabric due to exposure of the fabric to ultraviolet light.

11. The method of claim 10 wherein the bleaching agent is selected from the group consisting of potassium permanganate, sodium permanganate and sodium hypochlorite.

12. The method of claim 10 wherein the acid comprises phosphoric acid.

13. The method of claim 10 wherein the bleaching agent is selected from the group consisting of potassium permanganate, sodium permanganate and sodium hypochlorite and the acid comprises phosphoric acid.

* * * * *